US010119544B2

(12) United States Patent
Malvasi et al.

(10) Patent No.: US 10,119,544 B2
(45) Date of Patent: Nov. 6, 2018

(54) AUTOMOTIVE ELECTRIC LIQUID PUMP

(71) Applicant: PIERBURG PUMP TECHNOLOGY GMBH, Neuss (DE)

(72) Inventors: Alessandro Malvasi, Leghorn (IT); Robin Wegener, Cologne (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 113 days.

(21) Appl. No.: 14/440,596

(22) PCT Filed: Nov. 6, 2013

(86) PCT No.: PCT/EP2013/073195
§ 371 (c)(1),
(2) Date: May 5, 2015

(87) PCT Pub. No.: WO2014/072360
PCT Pub. Date: May 15, 2014

(65) Prior Publication Data

US 2015/0300356 A1 Oct. 22, 2015

(30) Foreign Application Priority Data

Nov. 7, 2012 (EP) ..... 12191652

(51) Int. Cl.
*F04D 13/06* (2006.01)

(52) U.S. Cl.
CPC ..... *F04D 13/06* (2013.01); *F04D 13/0606* (2013.01)

(58) Field of Classification Search
CPC . H02K 5/128; F04D 13/0606; F04D 13/0613; F04D 13/0626
See application file for complete search history.

(56) References Cited

U.S. PATENT DOCUMENTS 3,960,468 A 6/1976 Boorse et al.
4,605,359 A * 8/1986 Suzuki ..... F04B 1/0456 417/270
4,998,863 A 3/1991 Klaus
5,785,013 A 7/1998 Sinn et al.
6,350,109 B1 * 2/2002 Brunet ..... F04D 29/0465 417/365

(Continued)

FOREIGN PATENT DOCUMENTS

BE 624 399 A 3/1963
CN 1773123 A 5/2006

(Continued)

OTHER PUBLICATIONS

X. Wang: "Precise Mechanical Motion Control System", Science Press, English Translation of pp. 114-116 (2009).

*Primary Examiner* — Patrick Hamo
(74) *Attorney, Agent, or Firm* — Norman B. Thot

(57) ABSTRACT

An automotive electric liquid pump includes a pump wheel, an EC-motor which directly drives the pump wheel, and a cover disk. The EC-motor comprises a wet motor rotor. The wet motor rotor comprises a ring-like motor rotor cavity, and a motor rotor body comprising a cylindrical rotor body section. The cylindrical rotor body section is permanently magnetized and surrounds a motor rotor cavity which is ring-like. The cover disk is arranged at a longitudinal rotor end opposite to the pump wheel. The cover disk closes the motor rotor cavity.

8 Claims, 5 Drawing Sheets

(56) References Cited

U.S. PATENT DOCUMENTS

| | | | | |
|---|---|---|---|---|
| 6,663,362 | B1 * | 12/2003 | Lentz | H02K 1/145 310/253 |
| 7,131,823 | B2 * | 11/2006 | Kalavsky | F04D 13/0646 417/356 |
| 7,819,640 | B2 * | 10/2010 | Kalavsky | F04D 29/426 417/369 |
| 2004/0051416 | A1 | 3/2004 | Yamada et al. | |
| 2004/0062664 | A1 * | 4/2004 | Weigold | F04D 29/5813 417/357 |
| 2006/0034717 | A1 | 2/2006 | Castellone et al. | |
| 2007/0086901 | A1 | 4/2007 | Kim | |
| 2007/0090704 | A1 * | 4/2007 | Chen | F04D 13/0673 310/86 |

FOREIGN PATENT DOCUMENTS

| | | | |
|---|---|---|---|
| CN | 1847667 | A | 10/2006 |
| DE | 1 041 364 | B | 10/1958 |
| EP | 0 286 822 | A2 | 10/1988 |
| EP | 0 778 649 | A1 | 6/1997 |
| FR | 1.414.030 | A | 10/1965 |
| JP | 2004-512462 | A | 4/2004 |
| JP | 2004-156909 | A | 6/2004 |
| JP | 2007-318987 | A | 12/2007 |
| WO | WO 02/35098 | A1 | 5/2002 |

* cited by examiner

AUTOMOTIVE ELECTRIC LIQUID PUMP

CROSS REFERENCE TO PRIOR APPLICATIONS

This application is a U.S. National Phase application under 35 U.S.C. § 371 of International Application No. PCT/EP2013/073195, filed on Nov. 6, 2013 and which claims benefit to European Patent Application No. 12191652.2, filed on Nov. 7, 2012. The International Application was published in English on May 15, 2014 as WO 2014/072360 A1 under PCT Article 21(2).

FIELD

The present invention relates to an automotive electric liquid pump with an EC-motor directly driving a pump wheel.

BACKGROUND

Automotive liquid pumps with an electric motor are in particular used to pump a liquid coolant or lubricant, and are not only used in combination with internal combustion engines, but also with electric engines for driving the respective vehicle. A canned motor concept is used to avoid any kind of shaft sealing and to provide a fluid-tight construction. In a canned electric motor, the dry motor stator coils are electronically commutated (EC), and the motor rotor is permanently magnetized and is arranged within the pumping liquid. Suitable ferromagnetic materials for the magnetized motor rotor are relatively expensive, the motor rotor is therefore generally provided with a cylindrical rotor body section radially close to the motor stator coils so that the hollow cylindrical rotor body section surrounds a ring-like motor rotor cavity which is filled with the pumping liquid.

SUMMARY

An aspect of the present invention is to provide a liquid-tight automotive electric liquid pump with improved efficiency.

In an embodiment, the present invention provides an automotive electric liquid pump which includes a pump wheel, an EC-motor configured to directly drive the pump wheel, and a cover disk. The EC-motor comprises a wet motor rotor. The wet motor rotor comprises a ring-like motor rotor cavity, and a motor rotor body comprising a cylindrical rotor body section. The cylindrical rotor body section is configured to be permanently magnetized and to surround a motor rotor cavity which is configured to be ring-like. The cover disk is arranged at a longitudinal rotor end opposite to the pump wheel. The cover disk is configured to close the motor rotor cavity.

BRIEF DESCRIPTION OF THE DRAWINGS

The present invention is described in greater detail below on the basis of embodiments and of the drawings in which.

DETAILED DESCRIPTION

Figure 1:
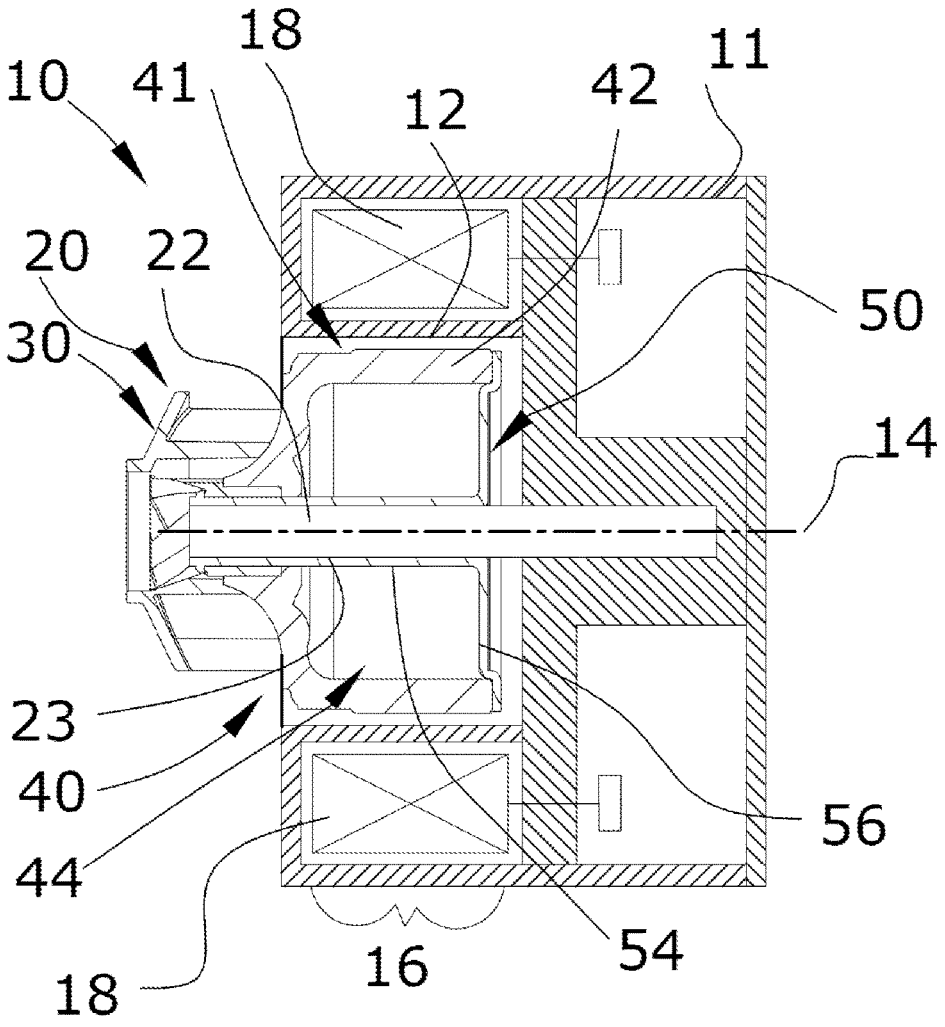
FIG. 1 shows a longitudinal cross-section of an automotive electric liquid pump with a wet motor rotor.

The automotive electric liquid pump is provided with an EC-motor which directly drives a pump wheel. The liquid pump can be a coolant pump for pumping, for example, water, or can be a lubricant pump for pumping, for example, oil, or can be another type of liquid pump. The electric motor is provided as a canned motor and is provided with a wet motor rotor rotating within the pumping liquid. The motor rotor comprises a motor rotor body with a cylindrical rotor body section which is permanently magnetized. The cylindrical rotor body section is hollow so that the cylindrical rotor body section surrounds a ring-like motor rotor cavity surrounding a rotating or non-rotating axial shaft. The complete motor rotor is more or less pot-shaped so that only a minimum of the relatively expensive permanent magnet material is needed for the magnetized motor rotor. The motor rotor can, for example, be provided as one single monolithic body made of a permanent magnet material.

A separate cover disc is provided at the longitudinal rotor end opposite the pump wheel. The pump wheel is provided at one longitudinal rotor end, and the cover disc is provided at the other longitudinal rotor end. The cover disk closes the motor rotor cavity so that no relevant liquid flow between the motor rotor cavity and the outside of the rotor is possible. Only the liquid surrounding the motor rotor therefore causes relevant friction with the motor rotor. The medium inside the covered and closed motor rotor cavity rotates with the same rotational speed as the motor rotor body. No relevant friction is therefore caused at the inner surface of the motor rotor body, and especially at the inner surface of the cylindrical rotor body section. Since frictional losses are reduced, the efficiency of the electric motor is accordingly increased.

In an embodiment of the present invention, the cover disc can, for example, be fluid-tight so that the motor rotor cavity is hermetically isolated from the surrounding liquid. No liquid exchange or flow between the motor rotor cavity and the liquid surrounding the motor rotor is therefore possible.

The motor rotor cavity can generally be filled with the pumping liquid or with air. Since a liquid pump pumping an aqueous coolant can be exposed to temperatures between −40° C. and +120° C., the pressure of air inside the closed motor rotor cavity can vary in a wide range. A liquid inside the motor rotor cavity can freeze and thereby destroy the motor rotor body. The motor rotor cavity can, for example, be filled with a solid cavity filling, for example, with a suitable monolithic plastic body. The solid cavity filling fills out most of the volume of the motor rotor cavity, if not the total volume of the motor rotor cavity, and avoids relevant mechanic stresses of the motor rotor body. Filling the motor rotor cavity with a solid cavity filling made out of plastic reduces the pump's total weight compared to a filling with the pumping liquid. The solid cavity filling is not ferromagnetic but can, for example, not be magnetic at all.

The cover disc can alternatively be provided with an opening so that a pressure equilibration between the motor rotor cavity and the outside is provided.

In an embodiment of the present invention, the cover disc can, for example, be a part of a cover body which also comprises a cylindrical bearing sleeve which is rotatably supported by a stationary rotor shaft. The cylindrical bearing sleeve and the stationary rotor shaft define a frictional bearing which is lubricated by the pumping liquid. The cover body combines two separate functions, i.e., a bearing function and a closing function.

In an embodiment of the present invention, the cover body defining the bearing sleeve and the cover disc can, for example, be made of a single sheet metal body. This allows for an efficient and cost-effective production and mounting of the bearing sleeve and the cover, and leads to a relatively light construction.

In an embodiment of the present invention, the pump wheel can, for example, be a separate part mounted together with the motor rotor and the cover body. The material of the pump wheel can, for example, be different from the material of the motor rotor and of the cover disc or of the cover body. This arrangement allows for the use of a suitable material for the pump wheel, for example, a suitable plastic material. Since each of the motor rotor body, the cover body, and the pump wheel can be made of an individually selected and suitable material, the material properties for each of these parts can be optimized with respect to mechanical qualities, costs and weight.

The pump wheel and the rotor motor body of the motor rotor can alternatively be provided as one single body, for example, they can be made out of plastic. In this case, the pump wheel can, for example, be designed as an open impeller without a cover disk defining and surrounding an axial liquid inlet opening.

In an embodiment of the present invention, the pump wheel can, for example, be an impeller with an axial liquid inlet and a radial liquid outlet as it is typically used in an automotive coolant pump.

One embodiment of an automotive electric liquid pump according to the present invention is described under reference to the enclosed drawings.

FIG. 1 shows a longitudinal cross-section of an automotive electric liquid pump 10 which is, in this case, provided as a coolant pump for pumping an aqueous coolant to an internal combustion engine of a land vehicle. The liquid pump 10 can alternatively also be provided as a lubricant pump, in particular, as an oil pump to pump relatively high volumes with relatively low pressure, for example, as a pump for pumping the lubricant from an oil sump higher into a lubricant reservoir. The liquid pump 10 is provided with an electronically commutated (EC-) motor 16 which directly drives an assembled rotor 20. The assembled rotor 20 is provided with a wet motor rotor 40 and a pump wheel 30 which is an impeller with an axial liquid inlet and a radial liquid outlet. The pump wheel 30, 30' of the first and the second embodiment shown in FIGS. 1 to 4 is provided with a covering 34 defining a liquid inlet opening 35.

The EC-motor 16 is a canned motor with a cylindrical separation can 12 separating dry motor stator coils 18 radially outside the separation can 12 from a wet motor rotor 40 radially inside the separation can 12. A pump housing 11 holds and supports an axial static bearing shaft 22 for supporting the rotating assembled rotor 20.

Figure 2:
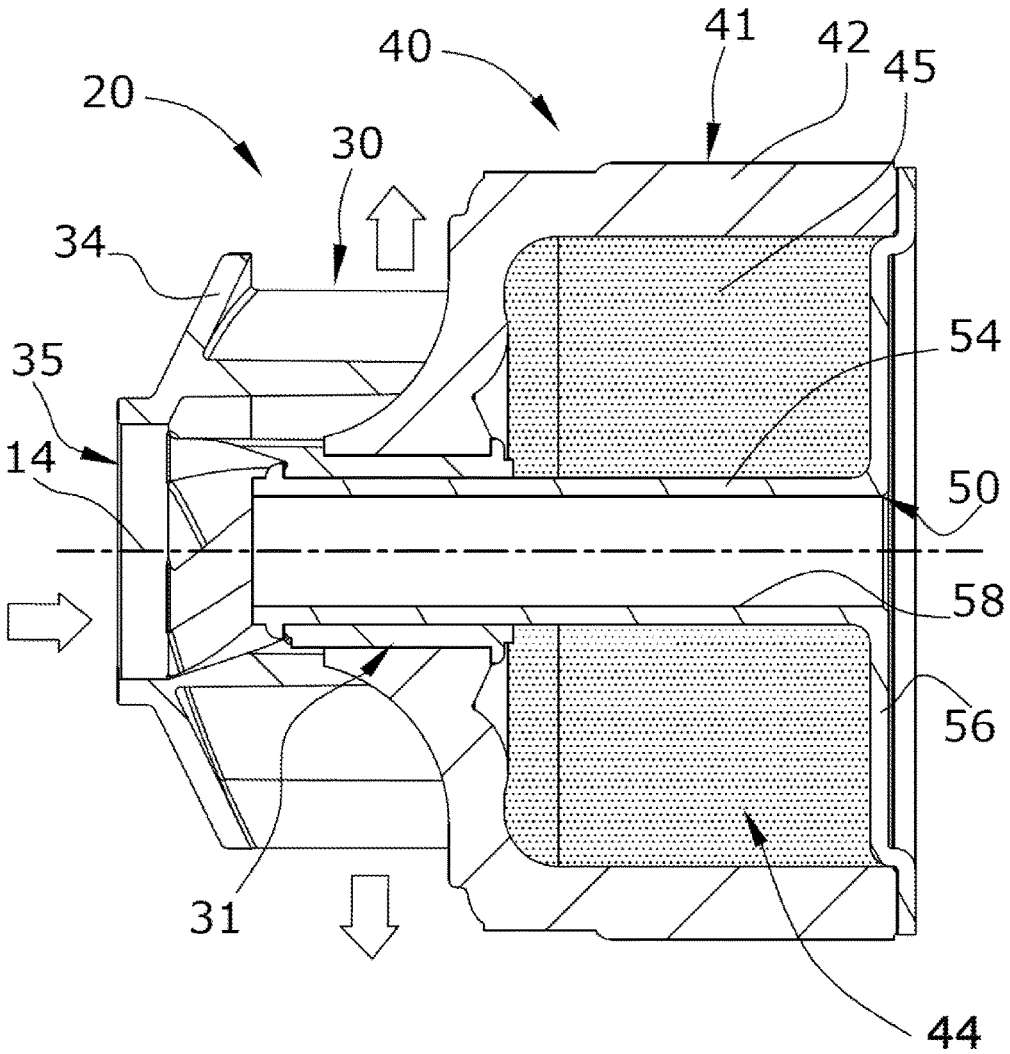
FIG. 2 shows an enlarged longitudinal cross section of the complete rotor comprising a pump wheel and a motor rotor.
Figure 3:
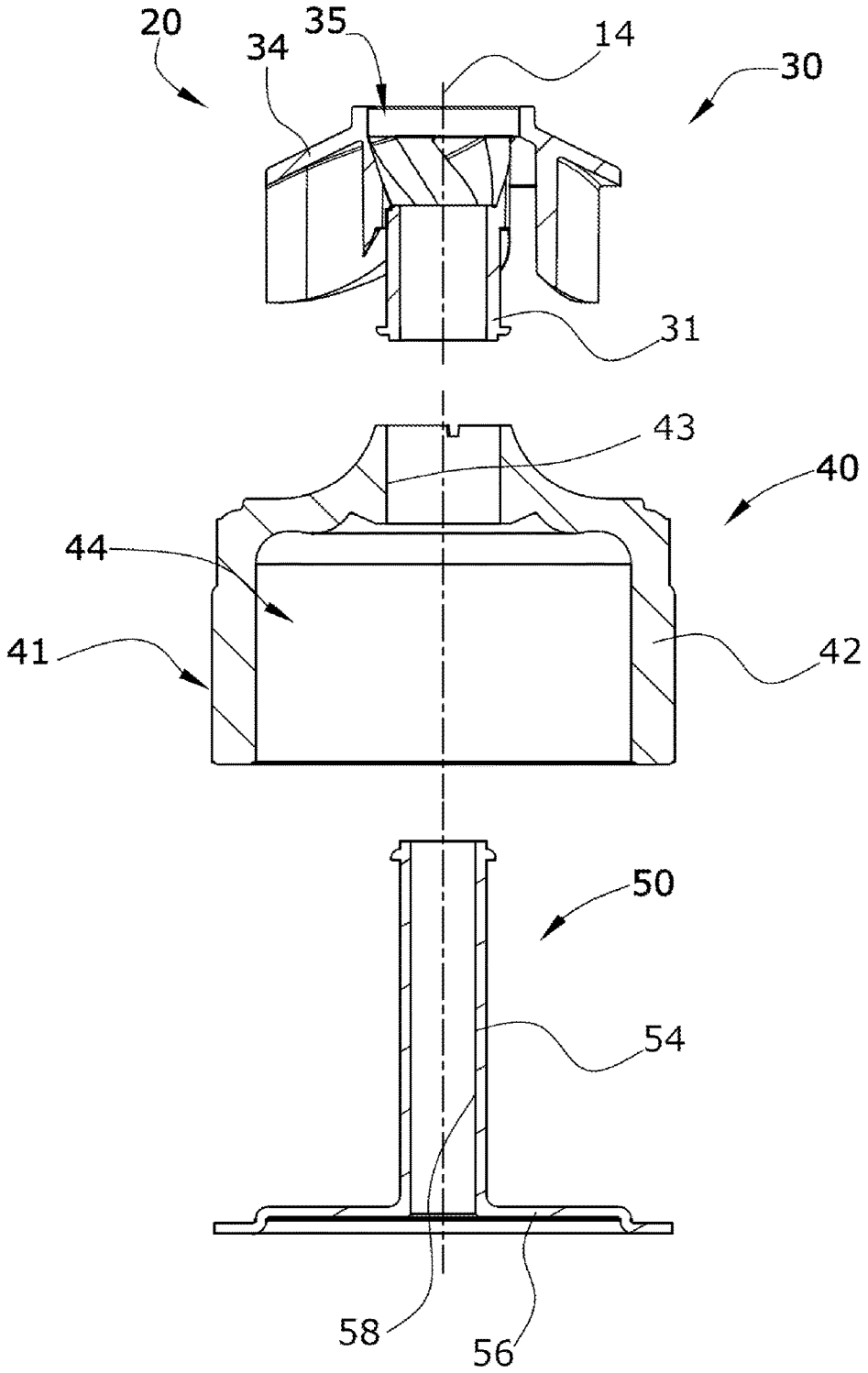
FIG. 3 shows a disassembled rotor in a longitudinal cross-section comprising a pump wheel, a motor rotor, and a cover body.

As can be seen in FIGS. 2 and 3, the assembled rotor 20 consists of three separate parts, namely, the pump wheel 30 which is made of plastic, the wet motor rotor 40, and a cover body 50 which is made out of a single sheet metal body. The wet motor rotor 40 is provided with a pot-formed motor rotor body 41 comprising a cylindrical rotor body section 42 which is the electro-magnetic element of the wet motor rotor 40. The complete motor rotor body 41 is made of a ferromagnetic material which is permanently magnetized. The cylindrical rotor body section 42 surrounds a ring-like motor rotor cavity 44 which is closed and covered by the cover body 50.

The cover body 50 is provided with a ring-like cover disc 56 lying in a transversal plane with respect to the longitudinal rotation axis 14 of the assembled rotor 20 and with a cylindrical bearing sleeve 54. The inner surface 58 of the bearing sleeve 54 and the outer surface 23 of the bearing shaft 22 together define a wet frictional bearing with a relatively long axial extension.

The cover body 50 and/or the motor rotor body 41 can alternatively both be made of plastic, whereby the motor rotor body 41 is provided with embedded permanent magnetic particles so that these bodies can be produced by injection molding.

The motor rotor body 41 and the cover body 50 together enclose the ring-like motor rotor cavity 44 which is filled with a solid cavity filling 45 of a suitable plastic material. Ring-like motor rotor cavity 44 can alternatively be filled with air or the pumping liquid.

The assembly of the assembled rotor 20 is explained referring to FIG. 3. First, the impeller pump wheel 30 is mechanically fixed to the motor rotor 40 by axially sticking an assembly cylinder 31 of the pump wheel 30 together with a cylindrical support portion 43 of the wet motor rotor 40. Alternatively or additionally, the pump wheel 30 can be fixed to the wet motor rotor 40 by gluing, hot forming, or hot mold-making, ultrasonic or vibration welding, laser welding, hot caulking or thermo-compression bonding. After the fixation of the pump wheel 30 at the wet motor rotor 40, a solid cavity filling 45 formed as a ring is inserted into the ring-like cavity 44. The cylindrical bearing sleeve 54 of the cover body 50 is then inserted into the assembly cylinder 31 of the pump wheel 30 until the cover disc 56 touches the cylindrical rotor body section 42. Finally, also the motor rotor body 41 and the cover body 50 are liquid-tight fixed to each other by one of the above mentioned methods.

Figure 4:
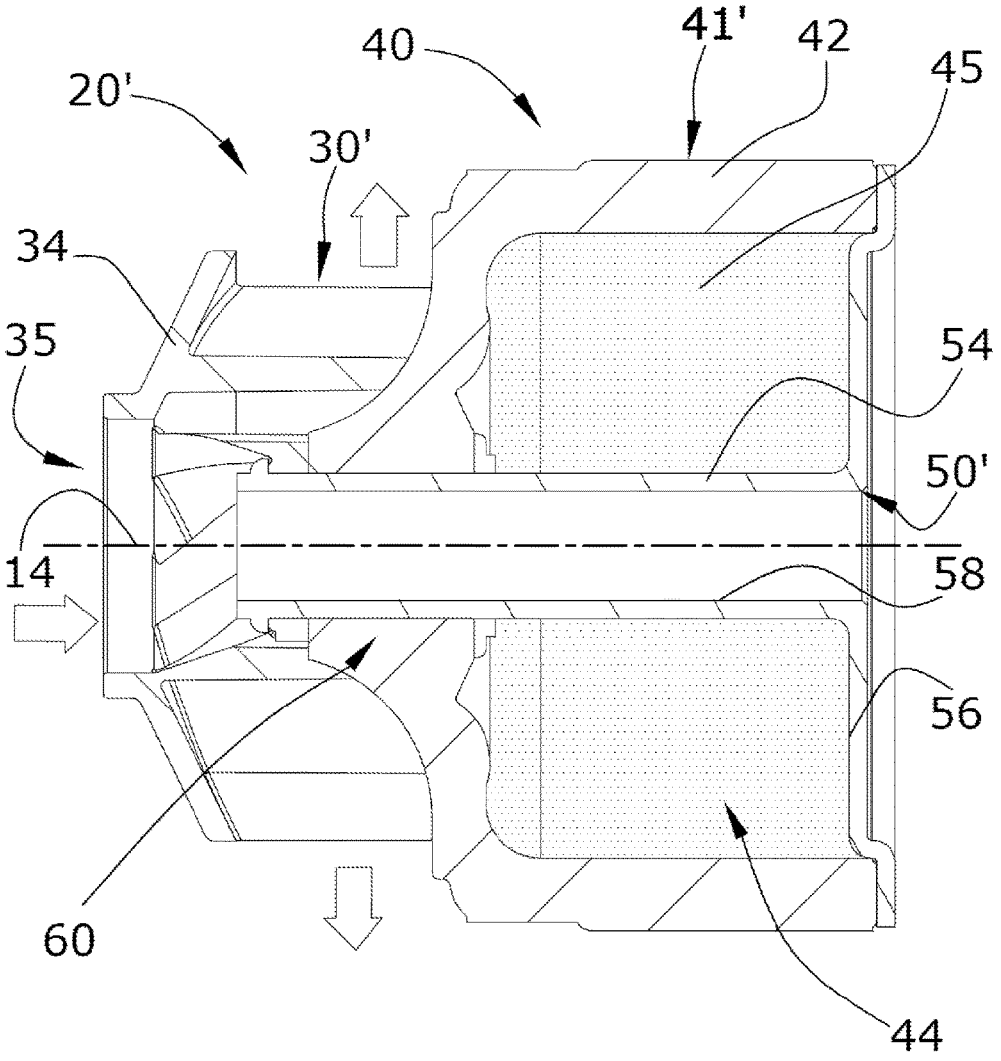
FIG. 4 shows an embodiment of a motor rotor with a motor rotor body being directly supported by a bearing sleeve at both longitudinal ends of the motor rotor.
Figure 5:
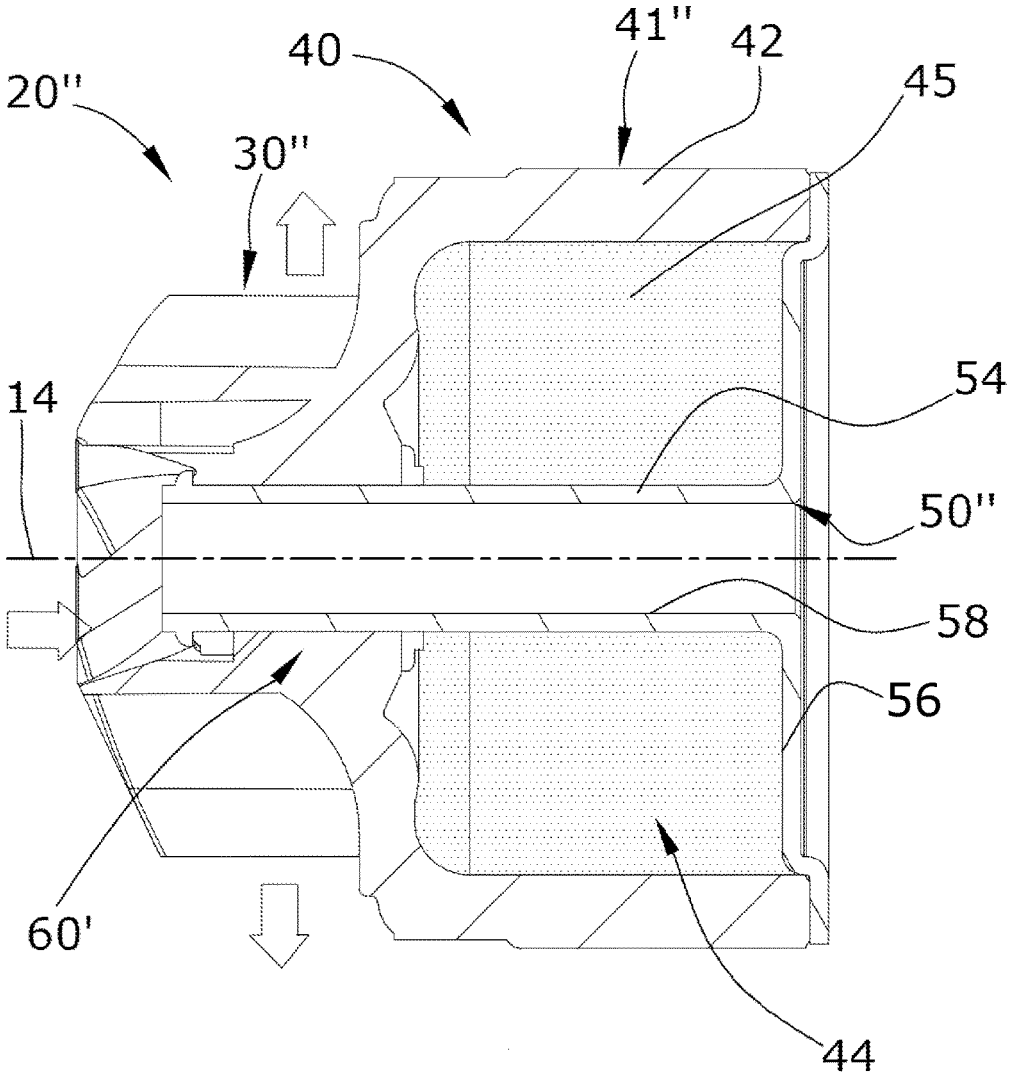
FIG. 5 shows an embodiment of a motor rotor with a motor rotor and a pump wheel being provided as one single piece.

A second embodiment of a rotor 20' is shown in FIG. 4. In contrast to the first embodiment of the rotor 20 of FIGS. 1 to 3, the assembled rotor 20' shown in in FIG. 4 is provided with a motor rotor body 41' which is provided with a support portion 60 and is directly supported by the bearing sleeve 54. The pump wheel 30' is therefore not provided with an assembly cylinder.

A third embodiment of a rotor 20" is provided with a pump wheel 30" and a motor rotor body 41" which are both unified in a single body, for example, made out of plastic. The pump wheel 30" is not provided with a cover ring to allow the production of the monolithic body by injection molding.

The present invention is not limited to embodiments described herein; reference should be had to the appended claims.

What is claimed is:

1. An automotive electric liquid pump comprising:

a pump wheel;

an EC-motor configured to directly drive the pump wheel, the EC-motor comprising a wet motor rotor, the wet motor rotor comprising, a ring-like motor rotor cavity, a motor rotor body comprising a cylindrical rotor body section, the cylindrical rotor body section being configured to be permanently magnetized and to surround the motor rotor cavity, and a cover body comprising a cylindrical bearing sleeve and a cover disk arranged at a longitudinal rotor end opposite to the pump wheel, the cover disk being configured to completely close the motor rotor cavity; and a stationary cylindrical bearing shaft configured to directly rotatably support the cover body, wherein, the wet motor rotor is provided as one single monolithic body which is made of a permanent magnet material.

2. The automotive electric liquid pump as recited in claim 1, wherein the cover disk is configured to be fluid-tight so as to hermetically isolate the motor rotor cavity.

3. The automotive electric liquid pump as recited in claim 1, wherein the motor rotor cavity is filled with a solid cavity filling.

4. The automotive electric liquid pump as recited in claim 1, wherein the cover body is provided as a sheet metal body.

5. The automotive electric liquid pump as recited in claim 1, wherein the pump wheel is provided as a separate part and is assembled with the wet motor rotor and the cover body.

6. The automotive electric liquid pump as recited in claim 1, wherein the pump wheel comprises a pump wheel material, the wet motor rotor comprises a motor rotor material, and the cover body comprises a cover body material, the pump wheel material being different from each of the motor rotor material and the cover body material.

7. The automotive electric liquid pump as recited in claim 1, wherein the pump wheel comprises an impeller comprising an axial liquid inlet and a radial liquid outlet.

8. The automotive electric liquid pump as recited in claim 1, wherein the pump wheel and the motor rotor body of the wet motor rotor are provided as a single body.

* * * * *